US007082992B2

(12) United States Patent
Amaya et al.

(10) Patent No.: US 7,082,992 B2
(45) Date of Patent: Aug. 1, 2006

(54) OIL WELL STEEL PIPE FOR EMBEDDING-EXPANDING

(75) Inventors: Hisashi Amaya, Kyoto (JP); Yuji Arai, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/284,918

(22) Filed: Nov. 23, 2005

(65) Prior Publication Data

US 2006/0073352 A1 Apr. 6, 2006

Related U.S. Application Data

(63) Continuation of application No. PCT/JP2004/007174, filed on May 26, 2004.

(30) Foreign Application Priority Data

May 28, 2003 (JP) ..... 2003-151269

(51) Int. Cl.
*E21B 7/28* (2006.01)
*C22C 38/02* (2006.01)

(52) U.S. Cl. ..... 166/207; 148/320

(58) Field of Classification Search ..... 166/207, 166/208; 148/320, 333, 334
See application file for complete search history.

(56) References Cited

U.S. PATENT DOCUMENTS

| | | | | |
|---|---|---|---|---|
| RE31,251 | E * | 5/1983 | Nakasugi et al. | 148/541 |
| 5,837,956 | A * | 11/1998 | Okabe et al. | 219/61 |
| 6,632,296 | B1 * | 10/2003 | Yoshinaga et al. | 148/320 |
| 6,749,954 | B1 * | 6/2004 | Toyooka et al. | 428/683 |
| 6,948,649 | B1 * | 9/2005 | Takahashi et al. | 228/173.4 |

FOREIGN PATENT DOCUMENTS

| | | |
|---|---|---|
| JP | 7-507610 | 8/1995 |
| JP | 10-17982 | 1/1998 |
| JP | 2000-199029 | 7/2000 |
| JP | 2002-266055 | 9/2002 |

* cited by examiner

*Primary Examiner*—Frank S. Tsay
(74) *Attorney, Agent, or Firm*—Clark & Brody

(57) ABSTRACT

An oil well steel pipe for embedding-expanding excellent in the SSC resistance after expanding. The pipe is made of a steel consisting of, by mass %, C: 0.05 to 0.45%, Si: 0.1 to 1.5%, Mn: 0.1 to 3.0%, P: 0.03% or less, S: 0.01% or less, sol.Al: 0.05% or less, and the balance being Fe and impurities, with a soluble N content of 40 ppm or less. The steel can comprise one or more selected from V, Ti, Nb, B, Cr, Mo, Ni, Cu and Ca.

8 Claims, 3 Drawing Sheets

OIL WELL STEEL PIPE FOR EMBEDDING-EXPANDING

This application is a Continuation of PCT/JP2004/007174, filed May 26, 2004, which was published in Japanese.

FIELD OF THE INVENTION

The present invention relates to a steel pipe, mainly used for an oil well or a gas well (hereinafter collectively referred to as an "oil well"), and more specifically, relates to an oil well steel pipe for embedding-expanding to be subjected to expanding working in an oil well and used as it is. The steel pipe is excellent in corrosion resistance after expansion.

BACKGROUND ART

In the excavation of an oil well, a number of pipes called casing are embedded in the well and thus the wall of the well is prevented from crumbling. In the excavation of a well, a hole is excavated by drilling until a certain depth is reached, and thereafter, a casing is inserted into the excavated well in order to prevent the crumbling of the wall of the well. In this way, the well is excavated by successively continuing the drilling operation; however, the casing, to be embedded when the excavation proceeds to reach the next stage depth, is inserted downward through the previously embedded casing, so that the diameter of the casing to be embedded afterward in a deeper portion is required to be made smaller than the diameter of the previously embedded casing.

In an oil well thus excavated, the diameter of the casing in the upper portion of the well is large, and the casing becomes smaller in diameter with increasing depth, finally through which a steel pipe, which is called tubing, for oil or gas production is inserted. Consequently, the diameter of the casing in the upper portion of the well is designed by backward calculation from the tubing diameter to be ensured when the well is excavated to a predetermined depth.

Accordingly, when a deep well is excavated, the size of the casing in the upper portion becomes large and the cost required for excavation is thereby increased.

As described in the patent document 1, a design is made in which by radially expanding the casings in the well, the diameter difference between each pair of successive casings forming the multistage casing structure is made smaller, and consequently, the size of the upper portion of the well is made smaller. This method is a method in which a steel pipe having a diameter smaller than the required diameter of a steel pipe is inserted in an oil well, and the pipe is subjected to expanding working in the oil well so as to have a outside diameter required for the steel pipe. By adopting this method, as described above, the diameter of the casing in the upper portion of the well can be suppressed to be smaller, and the cost required for well excavation can thereby be reduced.

When a steel pipe is expanded in an oil well, the steel pipe still in a state subjected to expanding working is exposed to the environment of the produced fluid such as oil and gas. Consequently, the steel pipe still in a state subjected to expanding working is required to have predetermined performances. This is because it is impossible to apply a heat treatment over the whole length of the steel pipes after expanding working for the purpose of improving the characteristics thereof.

Pipes for oil wells are shipped in a state subjected to heat treatment, and conventionally, the corrosion resistance, and among others, the resistance to the sulfide stress cracking (hereinafter referred to as "SSC" as the case may be) in the environment of wet hydrogen sulfide, namely, the sulfide stress cracking resistance (hereinafter referred to as "SSC resistance" as the case may be) are taken into account. However, for steel pipes to which the expanding working technique is applied, it is particularly important to consider the SSC resistance degradation due to the working hardening caused by expansion.

In the patent document 2, a steel pipe is proposed in which the SSC resistance after being subjected to the expanding working is ensured. However, the steel pipe presented therein is a steel pipe in which, because the SSC resistance after expanding working is affected by the crystal grains and the strength of the steep pipe before expanding working, the crystal grain size is made to be a predetermined value or less in a manner associated with the strength, and hence for the steel pipe, the SSC resistance after expanding working is ensured.

However, for the production of such a steel pipe disclosed in the above-mentioned document, an appropriate heat treatment for forming fine grains is indispensable, and the control of such a heat treatment is not an easy task. Additionally, in the patent document 2, there is no description on the relation between the N in steel, particularly, the soluble N (nitrogen) and the diffusive hydrogen largely affecting the SSC generation.

Patent Document 1:

Japanese Publication of International Patent Application No. 7-507610.

Patent Document 2:

Publication of unexamined Japanese Patent application No. 2002-266055.

DISCLOSURE OF THE INVENTION

Problem to be Solved by the Invention

An object of the present invention is the provision of an oil well steel pipe for embedding-expanding, which is excellent in the corrosion resistance after expanding working, more specifically, the SSC resistance.

Means for Solving Problem

In order to attain the above described subject, the present inventors, concerning the steel pipe made of a carbon steel and the steel pipe made of a low alloy steel, which are used as oil well steel pipes, paid attention to the SSC resistances of these pipes after applying the radially expanding working, in particular, the occlusion hydrogen penetrating into the steel in the environment of wet hydrogen sulfide, and examined in detail the relation between the trap site of the occlusion hydrogen and the constituent elements of the steel. Consequently, the present inventors perfected the present invention by obtaining the following findings a) and b).

a) Depending on whether the soluble N is abundant or not, the behavior of the hydrogen trap site is largely different.

b) In a steel in which the soluble N is abundant, the diffusive hydrogen causing the degradation of the SSC resistance is occluded in the steel with an increasing content with the increase of the working ratio of the expanding working, whereas in a steel in which no soluble N is contained or soluble N is present but small in the content thereof, in particular, a steel in which the content of soluble N is 40 ppm or less, the diffusive hydrogen content increases little even after applying the expanding working in comparison with the content before the expanding working.

The gist of the present invention perfected on the basis of the above described findings consists in the below described oil well steel pipe for embedding-expanding.

An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, and the balance being Fe and impurities, with a soluble N content of 40 ppm or less.

The above described oil well steel pipe for embedding-expanding may be made of a steel comprising, in place of a part of Fe, at least one component selected from at least one group of the following groups A to C.

Group A . . . V: 0.005 to 0.2%, Ti: 0.005 to 0.1%, Nb: 0.005 to 0.1% and B: 0.0005 to 0.005%;

Group B . . . . Cr: 0.1 to 1.5%, Mo: 0.1 to 1.0%, Ni: 0.05 to 1.5% and Cu: 0.05 to 0.5%; and Group C . . . Ca: 0.001 to 0.005%.

BEST MODE FOR CARRYING OUT THE INVENTION

Now, detailed description will be made below on the reason for specifying as described above the composition of the steel constituting the oil well steel pipe for embedding-expanding of the present invention. Incidentally, in what follows, "%" means "mass %" unless otherwise specified.

1. The Soluble N

At the beginning, the hydrogen trap site will be described. As a method for quantifying the content of the occluded hydrogen in a steel, here can be cited the method of the temperature programmed desorption analysis of hydrogen. In the method of the temperature programmed desorption analysis of hydrogen, while the temperature of the steel to be analyzed is being increased, the amounts of the hydrogen atoms desorbed at the respective temperatures are measured with the aid of a quadrupole mass spectrometer or the like. According to this method, depending on the activation energy magnitude of the hydrogen associated with the trapped state, the temperature at which the hydrogen is desorbed varies, and the amounts of hydrogen (the desorbed amounts of hydrogen) can be taken as the measure for representing the activation energies of hydrogen associated with the trapped states.

Heretofore, the embrittlement phenomena (hydrogen embrittlement) including the SSC have been considered to depend on the diffusive hydrogen. It is generally accepted that in the case of the measurement based on the above described temperature programmed desorption analysis of hydrogen, the hydrogen fractions released at the temperatures of 200° C. or below are to be associated with the diffusive hydrogen. The hydrogen fractions released at the temperatures higher than 200° C. involve the high values of activation energy associated with the hydrogen traps, and are irreversibly trapped hydrogen fractions, which scarcely diffuse at a room temperature. Thus, such hydrogen fractions are considered to affect the hydrogen embrittlement to a small extent.

In view of these circumstances, the effects of the component elements and the expanding working on the hydrogen trap site have been examined in more detail on the basis of the following procedures.

The 4 types of steels having the chemical compositions shown in Table 1 were produced by melting. By using these steels and applying hot forging, bars of 80 mm in diameter and 300 mm in length were produced. From these bars, by outside cutting and hollow machining, seamless steel pipes of 75 mm in outside diameter, 10 mm in wall thickness and 300 mm in length were produced. The yield strength [YS (MPa)] values and the Rockwell C scale hardness (HRC) values of these steel pipes were the values shown in Table 2.

Additionally, each of the amounts of the soluble N was taken as the value derived from the total amount of N in the steel concerned measured by the chemical analysis by subtracting the amount of N involved in the nitrides of Ti, Nb, Al, V, B and the like obtained by the extracted residual method.

Table 1

TABLE 1

| | Chemical Composition (mass %, the balance: Fe and impurities) | | | | | | | | | | |
|---|---|---|---|---|---|---|---|---|---|---|---|
| Mark | C | Si | Mn | P | S | Cr | Ti | B | sol. Al | Total N | Soluble N |
| A | 0.25 | 0.29 | 1.26 | 0.009 | 0.003 | 0.2 | 0.031 | — | 0.037 | 0.0085 | 0.0004 |
| B | 0.25 | 0.29 | 1.31 | 0.010 | 0.003 | 0.2 | 0.011 | — | 0.036 | 0.0006 | 0.0000 |
| C | 0.25 | 0.29 | 1.28 | 0.010 | 0.003 | 0.2 | 0.011 | 0.0013 | 0.038 | 0.0058 | 0.0021 |
| D | 0.26 | 0.28 | 1.26 | 0.009 | 0.002 | 0.2 | 0.007 | — | 0.023 | 0.0062 | 0.0045 |

Table 2

TABLE 2

| Mark | Yield Strength (YS) (MPa) | Hardness (HRC) |
|---|---|---|
| A | 630 | 22.0 |
| B | 642 | 23.3 |
| C | 618 | 19.5 |
| D | 625 | 19.7 |

Into these steel pipes after heat treatment, a plug for expanding was pushed and thus the radial expanding was conducted. The expansion ratio was varied by varying the plug size; two radial expansion ratios of 10% and 20% were adopted. The 4-point bending test specimens having the shape and size shown in FIG. 1 were sampled from the steel pipes before expanding and the steel pipes after expanding. These specimens were set in the bending jig 1 shown in FIG. 2, and the SSC resistances thereof were investigated by immersing the specimens in the Solution A specified in NACE TM-0177 (a test solution prepared by saturating with 1 atm $H_2S$ an aqueous solution of 5 mass % NaCl+0.5 mass % acetic acid) for 720 hours. In this case, the load stress was set at 85% of the standard minimum yield strength of 552 MPa (corresponding to 80 ksi).

On the other hand, the specimens of the steels having the marks A and D, of the 4-point bending test specimens after being subjected to the above described SSC resistance investigation test, were subjected to the investigation of the hydrogen occluded in steel on the basis of the above described temperature programmed desorption analysis of hydrogen. In this analysis, the temperature raising rate was set at 10° C./min.

The results of the SSC resistance investigation are shown in Table 3, and the results of the investigation based on the temperature programmed desorption analysis of hydrogen are shown in FIGS. 3 and 4.

Table 3

TABLE 3

| Mark | Soluble N (ppm) | Results of 4 Point Bending Test Radial Expansion Ratio (%) 0% | 10% | 20% |
|---|---|---|---|---|
| A | 4 | ○ | ○ | ○ |
| B | 0 | ○ | ○ | ○ |
| C | 21 | ○ | ○ | X |
| D | 45 | ○ | X | X |

Note)
"○" denotes no generation of the SSC, and "X" denotes generation of the SSC.

FIG. 3 is a graph showing the relationship between the programmed temperature (° C.) and the hydrogen releasing rate (ppm/sec) for the steel designated with the mark D having a high soluble N content of 45 ppm. As shown in the figure, with increasing expanding working ratio, the first peak found in the range from 100 to 150° C. grows in height. This indicates that the amount of the diffusive hydrogen released at the temperatures of 200° C. or below increases with increasing expanding working ratio.

FIG. 4 is a graph showing the relationship between the programmed temperature (° C.) and the hydrogen releasing rate (ppm/sec) for the steel designated with the mark A having a low soluble N content of 4 ppm attained by fixing N as TiN through addition of Ti. In this case of the steel A, when subjected to expanding working, although the second peak found in the range from 200 to 400° C. grows, the first peak found below 200° C. exhibits little variation from the first peak before expanding.

Generally, when subjected to expanding working, the hardness is raised owing to the working hardening. The higher the hardness is, the more the dislocation is developed, and in such dislocation sites, the concentration of the diffusive hydrogen becomes high. However, as can be seen in FIGS. 3 and 4, the activation energy level of the diffusive hydrogen occluded in the steel after expanding working varies largely depending on the soluble N content, and the concentration of the diffusive hydrogen released at the temperatures of 200° C. or below is lower for the steel lower in the soluble N content. This means that in the steel low in the soluble N content, the growth of the hydrogen brittleness susceptibility, namely, the growth of the SSC susceptibility is suppressed to a low level.

In view of these results, the effect of the soluble N content on the hydrogen trap site was also investigated in more detail on the steel pipes made of the steels designated with the marks B and C. Consequently, it has been revealed that in the steels designated with the marks B and C low in the soluble N content, similarly to the case of FIG. 4, even when subjected to the expanding working, the first peak varies little, and the second peak newly comes to appear in the range from 200 to 400° C.

In the steels low in the soluble N content, the height of the second peak increases with increasing expanding working ratio. However, the second peak is associated with the release peak of the hydrogen high in the activation energy value, and the hydrogen concerned has small effect on the hydrogen embrittlement. In the steels A to C low in the soluble N content, even when subjected to expanding working, only the second peak concerned becomes higher, but the diffusive hydrogen content associated with the first peak is low compared to that in the steel D. When the amount of the diffusive hydrogen released in the first peak is large, the SSC resistance is degraded. However, the steels low in the diffusive hydrogen content are excellent in the SSC resistance even though the amount of hydrogen released in the second peak is large. To sum up, it has become clear that it is effective to lessen the soluble N content for the purpose of ensuring the excellent SSC resistance in a steel pipe after being subjected to expanding working.

Incidentally, when the expanding working is not applied, the first peak of a steel large in the soluble N content is almost the same as that of a steel low in the soluble N content, and the amounts of the occluded diffusive hydrogen of these steels are almost identical to each other.

FIG. 5 is a graph showing the relationship between the diffusive hydrogen content (ppm) released from the steel interior in the temperature range up to 200° and the Rockwell C scale hardness (HRC) for the steels designated with the marks A to D. As can be clearly seen in this figure, when subjected to expanding working, the hardness is increased owing to the working hardening. Generally, the higher the hardness is, the more the dislocation is developed and the larger the amount of the trapped diffusive hydrogen becomes. Heretofore, it has been considered that the hardness and the concentration of the diffusive hydrogen occluded in steel are related with each other in a uniquely proportional manner. However, as can be seen in FIG. 5, depending on the soluble N content in steel, the level of the diffusive hydrogen concentration in relation to the hardness when varied by expanding working varies, and a steel lower in the soluble N content is lower in the concentration of the diffusive hydrogen when viewed at a fixed hardness. In other words, it can be seen that the increase of the hydrogen brittleness susceptibility, namely, the SSC susceptibility is suppressed to a low level, in conformity with the fact that the soluble N content is small.

Actually, as can be seen from the SSC generation behavior shown in Table 3, when expanding working was applied, the SSC was generated solely in the steel D having the soluble N content exceeding 40 ppm, but the steels A to C low in the soluble N content maintained the excellent SSC resistance even when subjected to expanding working, and particularly, the steels designated with the marks A and B, respectively having the soluble N contents of 4 ppm and 0 ppm, exhibited the excellent SSC resistance even when subjected to expanding working with a severe radial expansion ratio of 20%.

On the basis of the above described grounds, in the present invention, the soluble N content in the steel material is specified to be 40 ppm or less.

Incidentally, for the purpose of making the soluble N content in a steel be 40 ppm or less, the total content of N in the steel may be reduced, or the N may be fixed by positively adding the nitride forming elements such as Ti, Nb, V, B and Al; however, no particular constraint is imposed on the method for reducing the soluble N content in a steel.

For the purpose of sufficiently fixing the soluble N in a steel as nitrides, it is necessary that in consideration of the balance between the total N content and the soluble N content so as to make the soluble N content equal to or lower than the targeted content, the nitride formation elements such as Ti, Nb, V, B and Al are added in the amounts estimated to be necessary from the equivalent amount relations holding when the nitrides are formed. However, the amounts thus estimated may be insufficient, and accordingly, it is important to determined the addition amounts of these elements in consideration of the following descriptions.

In other words, the soluble N content in a steel is not only determined by the conditions of the production by melting, but is varied in a manner complicatedly affected by the production conditions involved in the subsequent stages, for example, the factors at the time of pipe production including the billet heating condition, the temperature at the completion of the pipe production, the temperatures and the time periods of the heating and cooling processes for the purpose of hardening, and the temperatures and the time periods of the heating and cooling processes for the purpose of tempering. Accordingly, it is important to determine the addition amounts of the nitride forming elements such as Ti, Nb, V, B and Al, by taking account of the above described factors in a comprehensive manner.

For the purpose of extremely taking advantage of the reactions at high temperatures where the nitride growth is fundamentally fast, it is desirable that the high temperature retention time is made as long as possible, and the reactions are thereby allowed to proceed to a sufficient extent which meets the addition amounts of the nitride forming elements.

Additionally, the types of nitrides formed at different temperature ranges are different from each other, and hence it is desirable to optimize the heating temperature and time according to the types of the above described nitride forming elements such as Ti and Nb. For example, in the case of a steel added with a needed amount of Ti as the nitride forming element where N is fixed with Ti, it is desirable to carry out the billet heating at the time of pipe production at 1,250° C. or above for 20 minutes or more. Additionally, in the case where N is fixed by adding Al or Nb, at the time of hardening conducted after pipe production, it is desirable to carry out soaking heating at 900° C. or above for 15 minutes or more.

Further, the wall thickness of the steel pipe being produced affects the nitride formation. For example, a thick wall material is slow in cooling rate, and hence it can be expected that the nitride formation proceeds during the time interval between the time of the taking out at the time of hardening from the heating furnace and the time of starting water cooling; accordingly, the soaking time can be shortened by the above described time interval. However, a thin wall material is fast in cooling rate, so that the time management in the furnace comes to be important.

2. Components Other Than the Soluble N

C: 0.05 to 0.45%

C is an element necessary for ensuring the steel strength and for attaining the sufficient hardenability. For the purpose of obtaining these effects, the content of C of at least 0.05% is necessary. On the other hand, if the content of C exceeds 0.45%, the hardening crack susceptibility at the time of hardening is increased. Accordingly, the content of C is made to be 0.05 to 0.45%. The preferable lower limit is 0.1% and the preferable upper limit is 0.35%.

Si: 0.1 to 1.5%

Si is an element having the effect as a deoxidizing agent and the effect of enhancing the tempering softening resistance and thereby raising the strength. However, with the content of Si less than 0.1%, these effects cannot be fully attained. On the other hand, with the content of Si exceeding 1.5%, the hot workability of the steel is markedly degraded. Accordingly, the content of Si is made to be 0.1 to 1.5%. The preferable lower limit is 0.2% and the preferable upper limit is 1.0%.

Mn: 0.1 to 3.0%

Mn is an element effective for increasing the steel hardenability and for ensuring the steel pipe strength. With the content of Mn less than 0.1%, these effects cannot be attained. On the other hand, with the content of Mn exceeding 3.0%, the segregation of Mn is enhanced and the toughness is lowered. Accordingly, the content of Mn is made to be 0.1 to 3.0%. The preferable lower limit is 0.3% and the preferable upper limit is 1.5%.

P: 0.03% or Less

P is an element contained in steel as an impurity; if the content thereof exceeds 0.03%, P segregates on the grain boundary and degrades the toughness, so that the content of P is made to be 0.03% or less. The content of P is preferably 0.015% or less. Additionally, it is preferable that the content of P is as small as possible.

S: 0.01% or Less

S is an element contained in steel as an impurity, similarly to the above described P, and forms sulfide inclusion with Mn, Ca and the like to degrade the toughness, if the content of S exceeds 0.01%, the toughness degradation becomes remarkable. Accordingly, the content of S is made to be 0.01% or less. The content of S is preferably 0.005% or less. Additionally, it is also preferable that the content of S is as small as possible.

sol.Al: 0.05% or Less

Al is added as a deoxidizing agent; if the content of Al exceeds 0.05% in terms of the content of sol.Al, the toughness lowering is caused and additionally the deoxidizing effect is saturated. Accordingly, the content of Al is made to be 0.05% or less in terms of the content of sol.Al. The preferable content is 0.03% or less. For the purpose of merely obtaining the deoxidizing effect, the lower limit can be at a level of impurity. However, Al has an effect to form AlN and to fix N; this effect can be attained with the content of sol.Al of 0.001% or more, so that it is recommended that the content of sol.Al is made to be 0.001% or more when the above mentioned effect is desired.

An oil well steel pipe for embedding-expanding of the present invention is made of a steel having the above described chemical composition and the balance being Fe and impurities other than P and S.

Another oil well steel pipe for embedding-expanding of the present invention is made of a steel having, in addition to the above described components, in place of a part of Fe, at least one component selected from at least one group of the below described groups A to C.

Group A . . . V: 0.005 to 0.2%, Ti: 0.005 to 0.1%, Nb: 0.005 to 0.1% and B: 0.0005 to 0.005%;

Group B . . . Cr: 0.1 to 1.5%, Mo: 0.1 to 1.0%, Ni: 0.05 to 1.5% and Cu: 0.05 to 0.5%; and Group C . . . Ca: 0.001 to 0.005%.

Now, description will be made below on these components.

V, Ti, Nb, B:

Any one of these elements has the effect for forming nitride and thereby fixing N in steel. In other words, these elements are the elements that reduce the soluble N content. Accordingly, when the effect of these elements are desired, one or more of these elements may be added, and the desired effect can be obtained with the content of 0.005% or more for V, Ti and Nb, and with the content of 0.0005% or more for B. However, when the content of V exceeds 0.2%, the content of Ti and Nb exceeds 0.1%, or the content of B exceeds 0.005%, the degradation of the toughness of the steel is caused. Accordingly, it is recommended that the contents of these elements, when they are added, are made to be as follows: 0.005 to 0.2% for V, 0.005 to 0.1% for Ti and Nb, and 0.0005 to 0.005% for B.

Incidentally, V has an effect for forming VC at the time of tempering to enhance the softening resistance and thereby improving the steel strength; Ti and Nb also have an effect for forming fine carbonitrides at high temperatures to prevent the coarse crystal grain formation.

Cr, Mo, Ni, Cu:

Any one of these elements is an element effective for improving the hardenability and thereby improving the strength. When the effect of these elements is desired, one or more of these elements may be added; the desired effect can be obtained with the content of 0.1% or more for Cr and Mo, and with the content of 0.05% or more for Ni and Cu. However, when the content of Cr or Ni exceeds 1.5%, the content of Mo exceeds 1.0%, or the content of Cu exceeds 0.5%, the degradation of the toughness and the degradation of the corrosion resistance are caused. Accordingly, it is recommended that the contents of these elements, when they are added, are made to be as follows: 0.1 to 1.5% for Cr, 0.1 to 1.0% for Mo, 0.05 to 1.5% for Ni and 0.05 to 0.5% for Cu.

Ca:

Ca is an element contributing to controlling the forms of the sulfides and effective for improving the toughness and the like. Accordingly, Ca may be added when the effect of Ca is desired; the desired effect can be obtained with the content of 0.001% or more. However, when the content exceeds 0.005%, there occur adverse effects including the generation of a large amount of inclusion to provide the origins for pitting corrosion. Accordingly, it is recommended that the content of Ca, when it is added, is made to be 0.001 to 0.005%.

EXAMPLE

The 22 types of steels having the chemical compositions shown in Table 4 were produced by melting, and were subjected to the test based on the following steps.

The steel ingot of each of the steels was subjected to soaking at 1,250° C. for 30 minutes, and then hot forging with a reduction in area of 30% was applied to obtain a bar of 80 mm in diameter and 300 mm in length. A seamless steel pipe of 75 mm in outer diameter, 10 mm in wall thickness and 300 mm in length was produced from the bar by outside cutting and hollow machining. The seamless steel pipe was subjected to soaking at 1,050° C. for 10 minutes and then to hardening by quenching with water. Then the pipe was subjected to the heat treatment of tempering by soaking at 650° C. for 30 minutes was applied. Thus, steel pipes for expanding having various contents of the soluble N were obtained.

The steel pipes for expanding thus obtained were subjected to radial expansion at room temperature, by pushing a plug for expansion from one end of each pipe toward the other end thereof. Two types of expansion were applied by varying the size of the plug in which the radial expansion ratios were 10% and 20%, respectively. From the steel pipes applied with these two types of expansion and the steel pipes before expanding, 4-point bending test specimens having the shape and size shown in FIG. 1 were sampled; the specimens were set in a bending jig 1 shown in FIG. 2 and then subjected to the sulfide stress-corrosion cracking test.

The sulfide stress-corrosion cracking test was conducted by immersing the specimens in the Solution A specified in NACE TM-0177 (a test solution prepared by saturating with 1 atm $H_2S$ an aqueous solution of 5 mass % NaCl+0.5 mass % acetic acid) for 720 hours. The specimens for which no generation of SSC was found was graded as excellent with a symbol "O", and the specimens for which generation of SSC was found was graded as poor with a symbol "x". In this case, the load stress was set at 85% of the standard minimum yield strength of 552 MPa (corresponding to 80 ksi).

The results thus obtained are shown in Table 5. It should be noted that Table 5 also shows the yield strengths YS (MPa) obtained by the room-temperature tensile test applied to the 12B specimens specified in JIS Z2241 sampled from the steel pipes before expanding.

TABLE 4

| | | Chemical Composition (mass %, the balance: Fe and impurities) | | | | | | | | |
|---|---|---|---|---|---|---|---|---|---|---|
| Group | Steel No. | C | Si | Mn | P | S | Ti | B | sol. Al | Total N |
| Examples of the Present Invention | 1 | 0.20 | 0.35 | 1.12 | 0.010 | 0.002 | — | — | 0.012 | 0.0032 |
| | 2 | 0.31 | 0.52 | 1.88 | 0.010 | 0.003 | — | — | 0.041* | 0.0018 |
| | 3 | 0.25 | 0.29 | 1.28 | 0.010 | 0.003 | 0.011* | — | 0.011 | 0.0048 |
| | 4 | 0.22 | 0.21 | 1.56 | 0.009 | 0.002 | — | 0.0015* | 0.011 | 0.0025 |
| | 5 | 0.12 | 0.25 | 1.74 | 0.010 | 0.002 | — | — | 0.009 | 0.0041 |
| | 6 | 0.20 | 0.35 | 2.20 | 0.015 | 0.001 | — | — | 0.001 | 0.0036 |
| | 7 | 0.21 | 0.44 | 1.01 | 0.012 | 0.001 | 0.012* | — | 0.012 | 0.0049 |
| | 8 | 0.18 | 0.32 | 1.55 | 0.011 | 0.001 | — | — | 0.011 | 0.0015 |
| | 9 | 0.25 | 0.58 | 1.58 | 0.010 | 0.002 | — | — | 0.015 | 0.0018 |
| | 10 | 0.24 | 0.18 | 1.80 | 0.050 | 0.001 | — | — | 0.010 | 0.0019 |
| | 11 | 0.15 | 0.35 | 1.35 | 0.011 | 0.001 | — | — | 0.031 | 0.0018 |
| | 12 | 0.24 | 0.22 | 1.18 | 0.015 | 0.001 | — | — | 0.022 | 0.0021 |
| | 13 | 0.12 | 0.33 | 1.39 | 0.011 | 0.002 | — | — | 0.028 | 0.0048 |
| | 14 | 0.10 | 0.25 | 1.94 | 0.009 | 0.001 | — | — | 0.009 | 0.0035 |
| | 15 | 0.10 | 0.25 | 2.10 | 0.016 | 0.002 | — | — | 0.008 | 0.0015 |
| | 16 | 0.23 | 0.24 | 1.11 | 0.010 | 0.002 | 0.052* | — | 0.008 | 0.0059 |
| | 17 | 0.19 | 0.27 | 1.36 | 0.009 | 0.001 | — | — | 0.022 | 0.0018 |
| | 18 | 0.21 | 0.28 | 1.26 | 0.015 | 0.002 | 0.018* | — | 0.026* | 0.0063 |

TABLE 4-continued

| | | | | | | | | | | |
|---|---|---|---|---|---|---|---|---|---|---|
| Comparative Examples | 19 | 0.26 | 0.32 | 1.09 | 0.012 | 0.001 | 0.012* | — | 0.012 | 0.0069 |
| | 20 | 0.23 | 0.25 | 1.29 | 0.011 | 0.002 | — | — | 0.009 | 0.0062 |
| | 21 | 0.15 | 0.23 | 2.10 | 0.010 | 0.001 | 0.007* | — | 0.023 | 0.0058 |
| | 22 | 0.22 | 0.28 | 1.35 | 0.013 | 0.002 | 0.010* | — | 0.023 | 0.0062 |

| | | Chemical Composition (mass %, the balance: Fe and impurities) | | | | | | | |
|---|---|---|---|---|---|---|---|---|---|
| Group | Steel No. | Soluble N | Nb | V | Mo | Cr | Ni | Cu | Ca |
| Examples of the Present Invention | 1 | 0.0030 | — | — | — | — | — | — | — |
| | 2 | 0.0014 | — | — | — | — | — | — | — |
| | 3 | 0.0019 | — | — | — | — | — | — | — |
| | 4 | 0.0012 | — | — | — | — | — | — | — |
| | 5 | 0.0022 | 0.018 | — | — | — | — | — | — |
| | 6 | 0.0023 | — | 0.13 | — | — | — | — | — |
| | 7 | 0.0007 | 0.008 | 0.005 | — | — | — | — | — |
| | 8 | 0.0012 | — | — | — | 0.2 | — | — | — |
| | 9 | 0.0013 | — | — | 0.8 | — | — | — | — |
| | 10 | 0.0018 | — | — | 0.1 | 0.4 | — | — | — |
| | 11 | 0.0011 | — | — | — | — | 0.26 | — | — |
| | 12 | 0.0018 | — | — | — | — | — | 0.06 | — |
| | 13 | 0.0029 | 0.017 | — | — | 0.2 | 0.38 | 0.22 | — |
| | 14 | 0.0031 | — | 0.011 | — | 0.2 | — | — | — |
| | 15 | 0.0010 | — | — | — | — | — | — | 0.001 |
| | 16 | 0.0000 | — | — | — | — | — | — | 0.002 |
| | 17 | 0.0015 | — | — | — | 1.5 | — | — | 0.004 |
| | 18 | 0.0000 | 0.021 | — | 0.3 | 0.5 | — | — | 0.003 |
| Comparative Examples | 19 | 0.0041* | — | — | — | — | — | — | — |
| | 20 | 0.0059* | — | — | — | — | — | — | — |
| | 21 | 0.0037 | — | — | 1.2* | 1.7 | — | — | — |
| | 22 | 0.0035 | — | — | — | — | — | — | 0.007* |

Note 1)
The symbol "*" signifies that the content falls outside the range specified in the present invention.
Note 2)
The symbol "—" signifies that the content is of the impurity level.

TABLE 5

| | | | SSC Resistance | | | |
|---|---|---|---|---|---|---|
| | | Yield Strength | Radial Expansion Ratio | | Overall | |
| Group | Steel No. | YS (MPa) | 10% | 20% | Evaluation | Remarks |
| Examples of the present invention | 1 | 611 | ○ | X | ○ | |
| | 2 | 595 | ○ | ○ | ◎ | |
| | 3 | 622 | ○ | ○ | ◎ | |
| | 4 | 612 | ○ | ○ | ◎ | |
| | 5 | 595 | ○ | X | ○ | |
| | 6 | 635 | ○ | X | ○ | |
| | 7 | 626 | ○ | ○ | ◎ | |
| | 8 | 680 | ○ | ○ | ◎ | |
| | 9 | 687 | ○ | ○ | ◎ | |
| | 10 | 706 | ○ | ○ | ◎ | |
| | 11 | 689 | ○ | ○ | ◎ | |
| | 12 | 701 | ○ | ○ | ◎ | |
| | 13 | 705 | ○ | X | ○ | |
| | 14 | 668 | ○ | X | ○ | |
| | 15 | 631 | ○ | ○ | ◎ | |
| | 16 | 593 | ○ | ○ | ◎ | |
| | 17 | 673 | ○ | ○ | ◎ | |
| | 18 | 677 | ○ | ○ | ◎ | |
| Comparative examples | 19 | 593 | X | X | X | The soaking time in forging is too short, the fixing of N is insufficient and the soluble N content falls outside the range too of the present invention. |
| | 20 | 618 | X | X | X | The content of N is too high, no nitride forming elements are added, and soluble N content falls outside the range of the present invention. |
| | 21 | 702 | X | X | X | The contents of Cr and Mo are excessive, and the SSC due to coarse carbides is generated. |
| | 22 | 636 | X | X | X | The content of Ca is excessive, and the SSC due to too much inclusion is generated. |

As can be seen in Table 5, the steel pipes made of the steels Nos. 1 to 18 are excellent in the SSC resistance after expanding working. Particularly, the steel pipes made of the steels Nos. 2 to 4, 7 to 12, and 15 to 18 are as extremely low as 20 ppm or less in the soluble N content, and hence maintain the excellent SSC resistances even after application of the expansion with the radial expansion ratio of 20%.

On the other hand, the steel pipes made of the steels Nos. 19 to 22 of the comparative examples are all poor in the SSC resistance after expanding. More specifically, the steel pipe made of the steel No. 19 is short in heating time in forging, insufficient in the fixing of N by Ti, and the soluble N content exceeds 40 ppm, so that this pipe is poor in the SSC resistance after expanding working. The steel pipe made of the steel No. 20 is not added with the nitride forming elements, so that this pipe is as high as 59 ppm in the soluble N content and poor in the SSC resistance. The steel pipe made of the steel No. 21 is too large in the contents of Cr and Mo, so that coarse carbides are generated and this pipe is poor in the SSC resistance. The steel pipe made of the steel No. 22 is excessive in the content of Ca, so that a large amount of inclusion is generated, the SSC which originated from the pitting corrosion was generated and this pipe is poor in the SSC resistance.

INDUSTRIAL APPLICABILITY

The oil well steel pipe for embedding-expanding of the present invention is excellent in the SSC resistance after expanding, and is extremely effective when used in the embedding-expanding method in which the pipe is expanded after embedded in the well.

EXPLANATION OF NUMERALS

1: Bending jig

Figure 1:
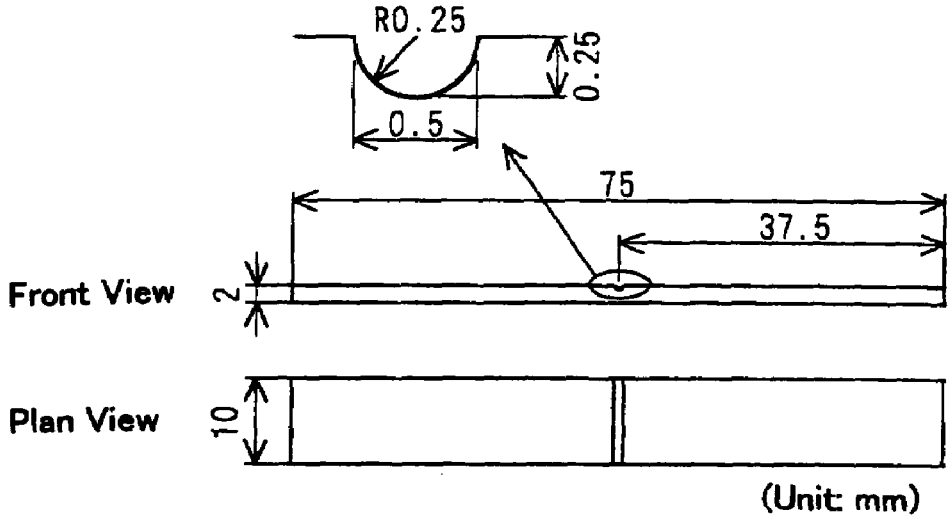
FIG. 1 is a diagram showing the shape and size of a 4 point bending test specimen.
Figure 2:
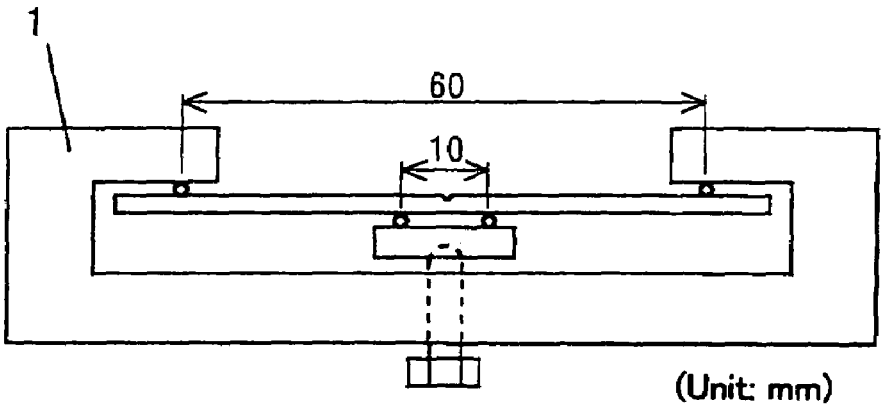
FIG. 2 is a diagram showing a bending jig and the condition in which a 4 point bending test specimen is set in the jig.
Figure 3:
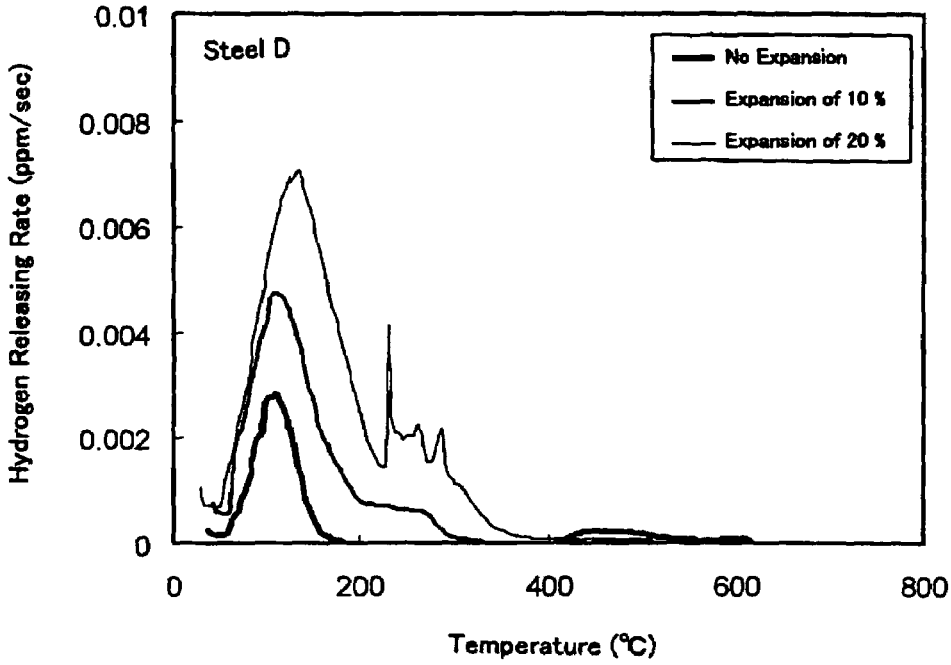
FIG. 3 is a graph showing the relationship between the temperature of a steel high in the soluble N content and the hydrogen releasing rate.
Figure 4:
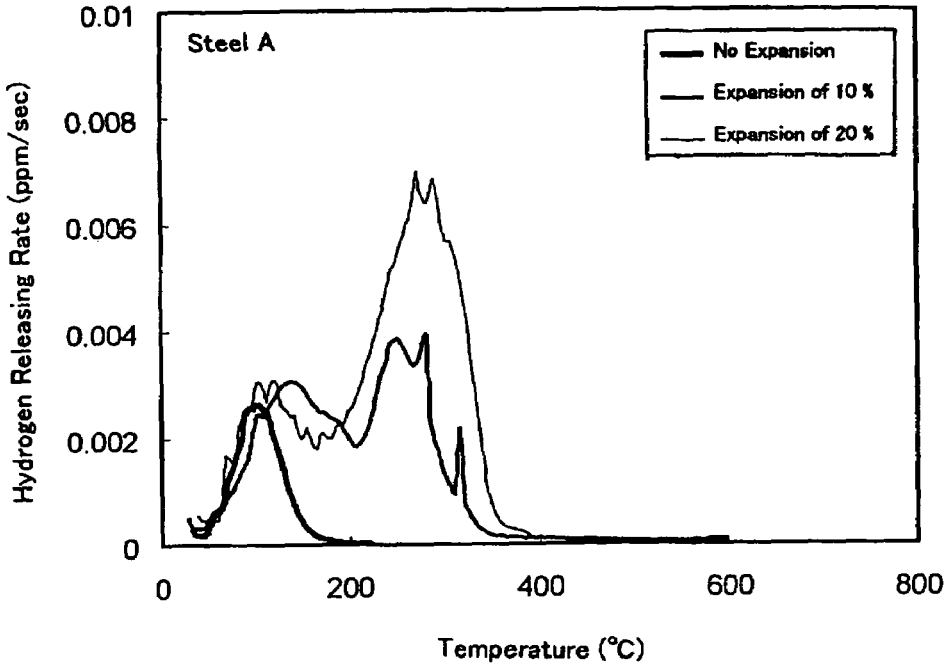
FIG. 4 is a graph showing the relationship between the temperature of a steel low in the soluble N content and the hydrogen releasing rate.
Figure 5:
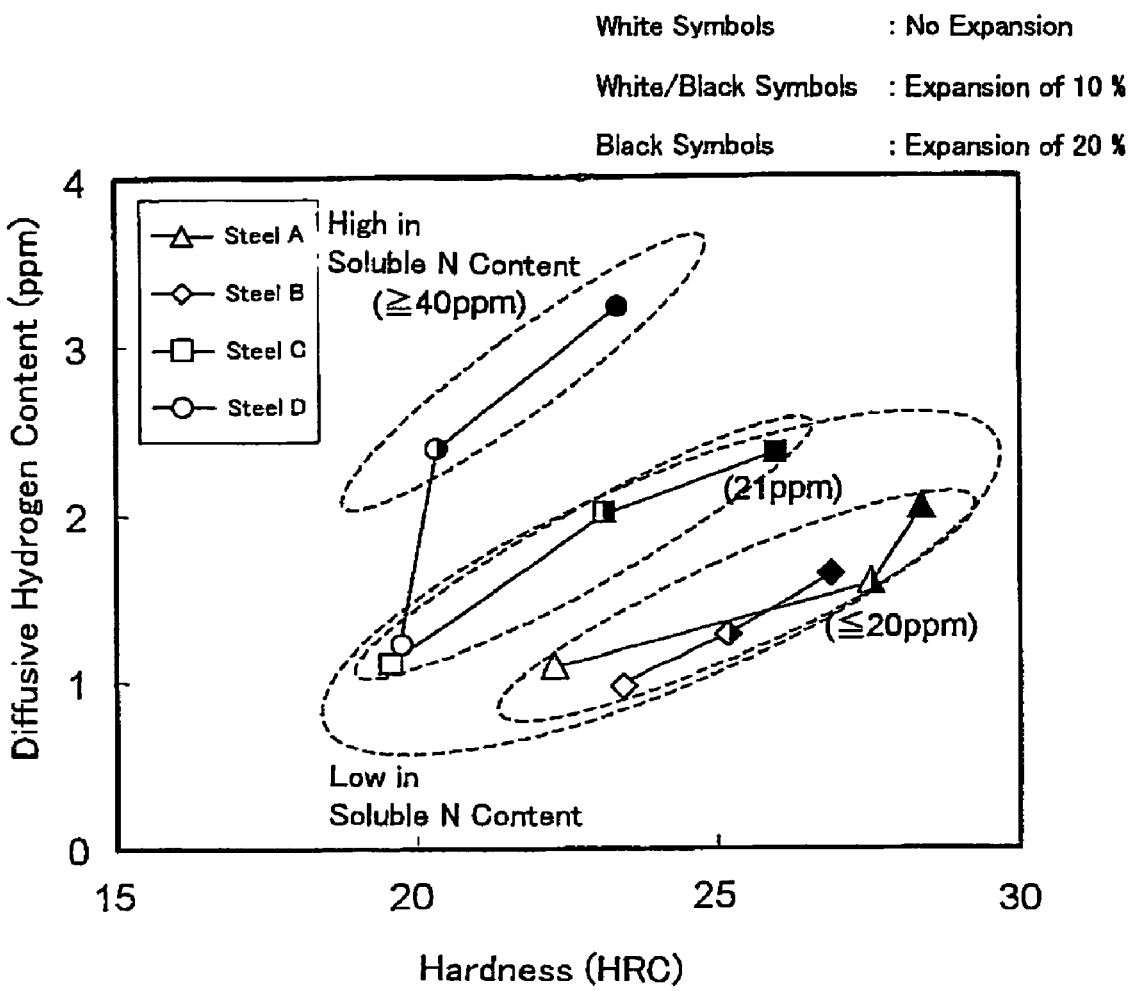
FIG. 5 is a graph showing the relationship between the diffusive hydrogen content in steel and the hardness.

The invention claimed is:

1. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, and the balance being Fe and impurities, with a soluble N content of 40 ppm or less.

2. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, one or more of V: 0.005 to 0.2%, Ti: 0.005 to 0.1%, Nb: 0.005 to 0.1% and B: 0.0005 to 0.005%, and the balance being Fe and impurities, with a soluble N content of 40 ppm or less.

3. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, one or more of Cr: 0.1 to 1.5%, Mo: 0.1 to 1.0%, Ni: 0.05 to 1.5% and Cu: 0.05 to 0.5%, and the balance being Fe and impurities, with a soluble N content of 40 ppm or less.

4. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, Ca: 0.001 to 0.005% and the balance being Fe and impurities, with a soluble N content of 40 ppm or less.

5. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, one or more of V: 0.005 to 0.2%, Ti: 0.005 to 0.1%, Nb: 0.005 to 0.1% and B: 0.0005 to 0.005%, one or more of Cr: 0.1 to 1.5%, Mo: 0.1 to 1.0%, Ni: 0.05 to 1.5% and Cu: 0.05 to 0.5%, and the balance being Fe and impurities, with a soluble N content of 40 ppm or less.

6. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, Ca: 0.001 to 0.005%, one or more of V: 0.005 to 0.2%, Ti: 0.005 to 0.1%, Nb: 0.005 to 0.1% and B: 0.0005 to 0.005%, and the balance being Fe and impurities, with a soluble N content of 40 ppm or less.

7. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, Ca: 0.001 to 0.005%, one or more of Cr: 0.1 to 1.5%, Mo: 0.1 to 1.0%, Ni: 0.05 to 1.5% and Cu: 0.05 to 0.5%, and the balance being Fe and impurities, with a soluble N content of 40 ppm or less.

8. An oil well steel pipe for embedding-expanding made of a steel which consists of, by mass %, C: 0.05 to 0.45%, Si: 0.1 to 1.5%, Mn: 0.1 to 3.0%, P: 0.03% or less, S: 0.01% or less, sol.Al: 0.05% or less, Ca: 0.001 to 0.005%, one or more of V: 0.005 to 0.2%, Ti: 0.005 to 0.1%, Nb: 0.005 to 0.1% and B: 0.0005 to 0.005%, one or more of Cr: 0.1 to 1.5%, Mo: 0.1 to 1.0%, Ni: 0.05 to 1.5% and Cu: 0.05 to 0.5%, and the balance being Fe and impurities, with a soluble N content of 40 ppm or less.

* * * * *